United States Patent [19]

Suroff

[11] 4,407,522

[45] Oct. 4, 1983

[54] ENERGY SAVING ICE SKATE ATTACHMENT DEVICE

[76] Inventor: Hyman Suroff, 6813 21st Ave., Brooklyn, N.Y. 11204

[21] Appl. No.: 474,435

[22] Filed: Mar. 11, 1983

[51] Int. Cl.[3] ..... A63C 3/04

[52] U.S. Cl. ..... 280/809; 280/11.14

[58] Field of Search ..... 280/7.13, 11.1 R, 11.12, 280/11.14, 11.18, 12 A, 12 AA, 809, 825

[56] References Cited

U.S. PATENT DOCUMENTS

| | | | |
|---|---|---|---|
| 2,120,397 | 2/1964 | Lepkofker | 280/11.12 |
| 2,764,417 | 9/1956 | Sweet | 280/11.14 |
| 2,867,445 | 1/1954 | Lachat | 280/11.12 |
| 2,920,897 | 1/1960 | Jensen | 280/11.12 |

FOREIGN PATENT DOCUMENTS

| | | | |
|---|---|---|---|
| 270069 | 8/1950 | Austria | 280/825 |

*Primary Examiner*—Joseph F. Peters, Jr.
*Assistant Examiner*—Timothy Roesch
*Attorney, Agent, or Firm*—Leonard W. Suroff

[57] ABSTRACT

An energy saving ice skate attachment device for attachment to an ice skate, or the like, also suitable for training skaters, includes an elongated frame with a pair of outboard blades having its edge portion coplanar with the blade of the ice skate, is clamped to the ice skate by means of a U-shaped clamping device which affixes the frame of the attachment device to the shoe supporting post of the ice skate. Resilient means are disposed between the horizontal portion of the attachment device frame and the underside of the ice skate shoe, thereby permitting at least two blades to contact the surface of the ice even during turns, thereby reducing the energy needed to utilize the skates.

9 Claims, 9 Drawing Figures

ENERGY SAVING ICE SKATE ATTACHMENT DEVICE

BACKGROUND OF THE INVENTION

1. Field of the Invention

The present invention relates to ice skate attachments, and in particular, to an ice skate attachment device which will save energy of the user thereof and is also suitable for the training of skaters.

2. Description of the Relevant Art

The art bounds with devices which are adapted to be affixed to ice skates in order to provide auxiliary or outboard runners for ice skates in order to improve the stability of the conventional single blade used thereon. Typical of these devices is U.S. Pat. No. 3,120,397 issued to H. Lepkofker on Feb. 4, 1964. The device disclosed therein utilizes a pair of outboard runners or auxiliary blades disposed on either side of the conventional ice skate blade and parallel thereto. The auxiliary blades are positioned in juxtaposition to the ice skate and may be adjusted to different levels to aid a skater in learning to ice skate.

Another auxiliary outboard device for attachment to ice skates is disclosed in U.S. Pat. No. 2,867,445 issued to P. J. Lachat on Jan. 6, 1959. This device is removably affixed to an ice skate and functions in a manner similar to that disclosed earlier.

Yet another device is disclosed in U.S. Pat. No. 2,764,417 issued to C. M. Sweet on Sept. 25, 1956. The device disclosed therein utilizes a pair of stabilizing runners disposed on either side of the conventional runner and is utilized in combination therewith to help an individual learn to ice skate. As disclosed, the devices utilize either one or more outboard ice skating blades to help in training a new ice skater until he gets accustomed to a single blade utilized on conventional ice skates today.

The device disclosed in the instant invention overcomes the shortcomings found in the art by providing a pair of outboard blades which may be affixed to a conventional ice skate. The blades extend the complete length of the skate and are readily affixed thereto. Resilient means are disposed between the underside of the shoe and the horizontal portion of the frame supporting the outboard blades permitting at least one outboard blade and the original blade to be in contact with the ice even when executing a turn, thus providing stability and act to broaden the support surface for the ice skater reducing ankle strain and the energy required to utilize same.

SUMMARY OF THE INVENTION

It is an object of the present invention to provide an energy saving ice skate attachment which contains a minimum of parts and is readily affixable to a conventional ice skate.

Another object of the present invention is to provide a pair of outboard blades for ice skates which will enable the user thereof to conserve energy and also permit a new skater to become accustomed to conventional ice skates.

It is yet another object of the present invention to provide an ice skate attachment device which will enable a user thereof to negotiate turns at high speed offering more stability than is available with present day single blade ice skates.

It is still yet another object of the present invention to provide an ice skate attachment device that permits at least two blades to be in contact with the ice at all times even when negotiating sharp turns.

The foregoing and other objects and advantages will appear from the description to follow. In the description reference is made to the accompanying drawing which forms a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

An energy saving ice skating attachment device for attachment to ice skates, or the like, according to the principles of the present invention, comprises an elongated frame having a centrally disposed longitudinal receptacle provided with an elongated centrally disposed slot adapted to receive the blade of an ice skate therethrough. Two longitudinal outboard ice skate blades are positioned on each side of the receptacle by a horizontal portion of the frame. The edges of the outboard blades are coplanar with the edge of the ice skate blade. A clamp device is provided to releasably affix the frame to one shoe support post of the ice skate to prohibit longitudinal movement between the ice skate blade and the outboard blades. A resilient device is disposed between the horizontal frame portion and the bottom surface of the shoe portion of the ice skate to permit the outboard blades to move in a rotational transverse direction.

BRIEF DESCRIPTION OF THE DRAWINGS

In order that the invention may be more clearly understood, it will now be described, by way of example, with reference to the accompanying drawings, in which.

DESCRIPTION OF THE PREFERRED EMBODIMENTS

Figure 1:
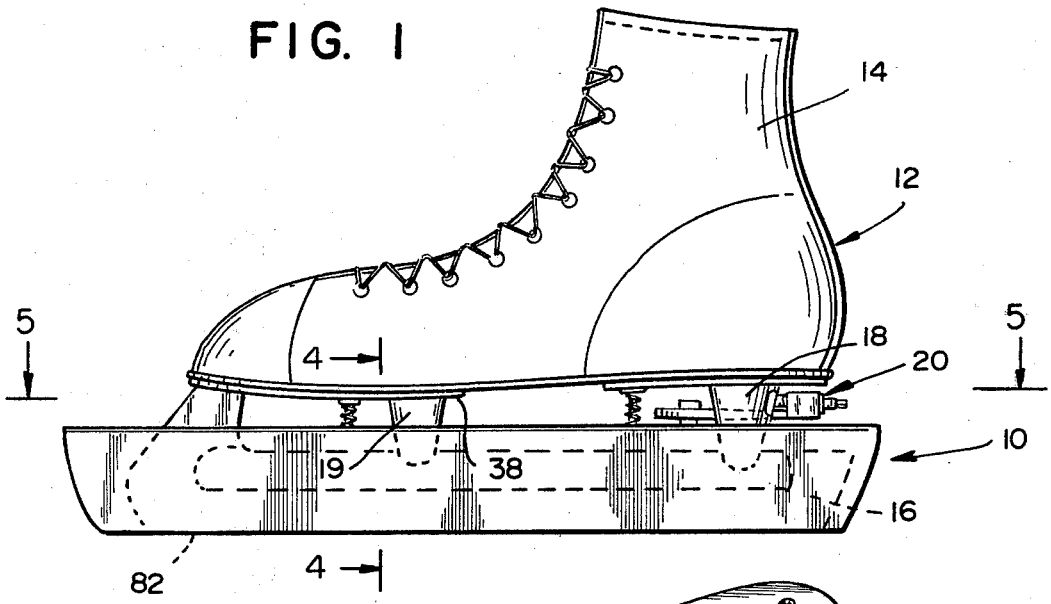
FIG. 1 is a pictorial representation of an ice skate having one embodiment of the attachment device affixed thereon according to the principles of the present invention.

Referring now to the figures, and in particular to FIG. 1, in which there is shown an energy saving ice skate attachment device 10 affixed to an ice skate 12 which includes an upper shoe portion 14 and a lower blade portion 16. The attachment device 10 is retained on the shoe support post 18 by means of a clamping bracket assembly 20 as shown in detail in FIG. 7.

Figure 2:
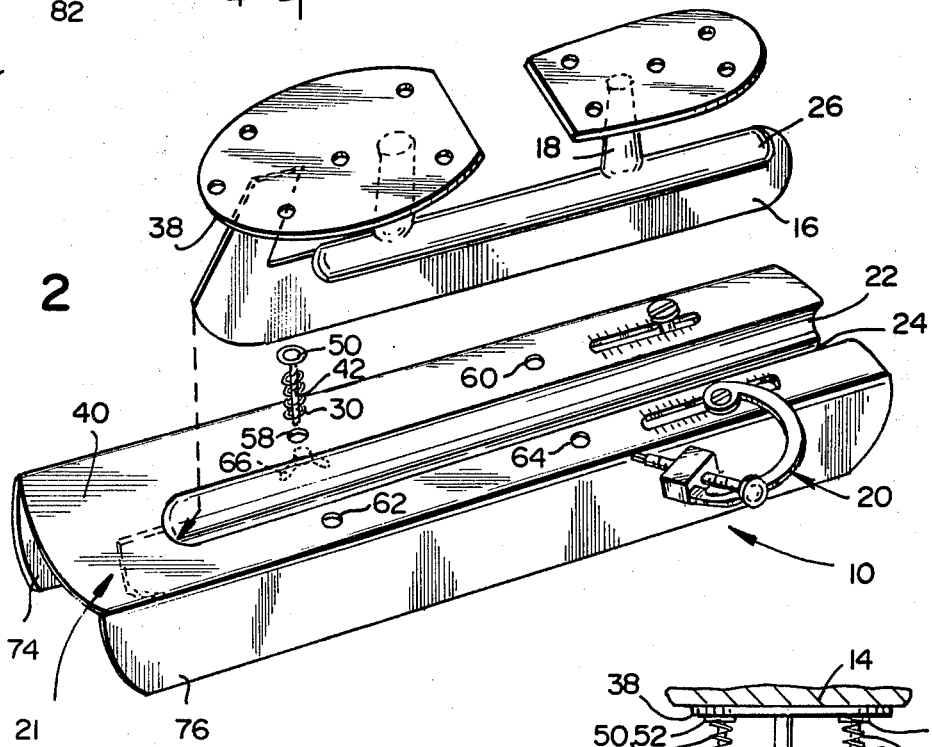
FIG. 2 is an exploded isometric view showing the lower portion (blade assembly) of an ice skate prior to insertion into the frame of the ice skate attachment device.

FIG. 2 shows an exploded view of the blade portion 16 of an ice skate 12 disposed above the attachment device 10 and ready for insertion into a frame 21 which is provided with a centrally disposed longitudinal channel or receptacle 22 which is provided with a centrally disposed slot 24 that is adapted to receive the blade portion 16 of an ice skate therethrough. The enlarged portion 26 of the blade portion 16 is adapted to cooperate with and rest upon the receptacle 22 and is free to move or rotate transversely therein in relatively small amounts. To improve its rotational ability a lubricating material 28 may be disposed in the receptacle 22 prior to insertion of the enlarged portion 26 therein allowing for free movement between the enlarged portion and the receptacle in a transverse direction, as will be explained hereinafter. Resilient members 30, 32, 34 and 36 are preferrably coil springs which are disposed between the bottom surface 38 of the shoe portion 14 and the horizontal flat portion 40 of the frame 21. The spring is held in position by a threaded rod 42, 44, 46 and 48 which is provided with a flat washer 50, 52, 54 and 56 at one distal end. On the other distal end of the threaded rod 42, 44, 46 and 48, after insertion through apertures 58, 60, 62 and 64, provided in the flat portion 40, a locking wing nut 66, 68, 70 and 72 is applied, thus retaining the coil springs 30, 32, 34 and 36 in position. Applying pressure on the washers 50, 52, 54 and 56 permits the rod 42, 44, 46 and 48 to move through the apertures 58, 60, 62 and 64 thus, permitting the ice skate to tilt or rotate relative to the flat portion 40 of the attachment device 10.

Figure 3:
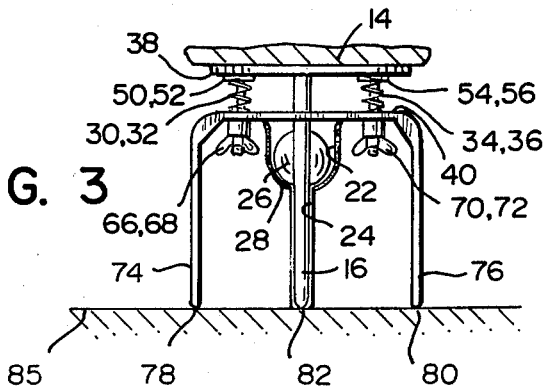
FIG. 3 is an end view in elevation of one embodiment of the present invention without the shoe portion of the skate appearing therein.
Figure 4:
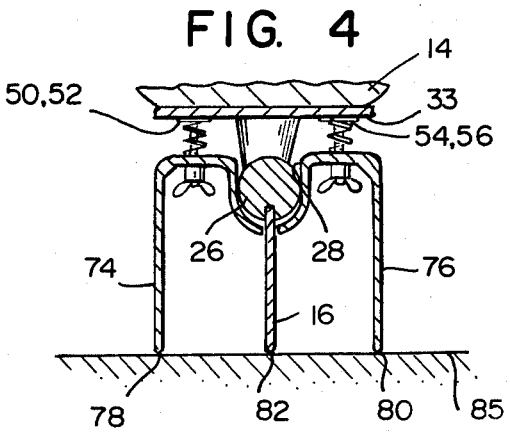
FIG. 4 is a cross-sectional view along the line 4—4 of FIG. 1.

Disposed on either side of the blade portion 16 and affixed to the flat portion 40 of the attachment device 10 are two outboard blades 74 and 76 with the edges 78 and 80, respectively, coplanar with the edge 82 of the blade portion 16 so that when moving in a straight line, edges 78, 80 and 82 all rest upon the ice 85 as shown in FIG. 3. When turning or going around a curve, as shown in FIG. 4, the edge 82 of the ice skate blade portion 16 will remain on the ice together with the blade on the inboard side of the turn because of the weight shift of the individual utilizing the attachment device on an ice skate.

Figure 9:
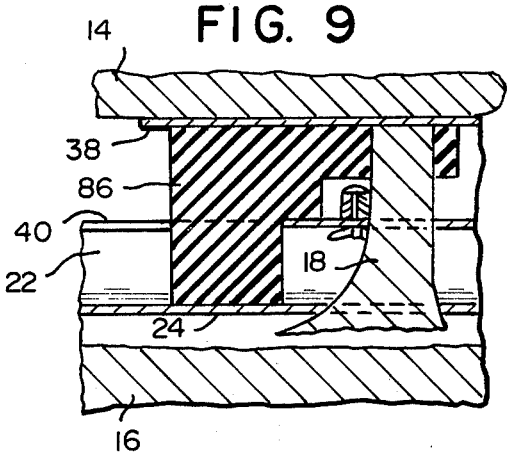
FIG. 9 is a cross-sectional view in elevation taken along the line 9—9 in FIG. 5 with the alternate resilient means utilized according to the principles of the present invention.
Figure 5:
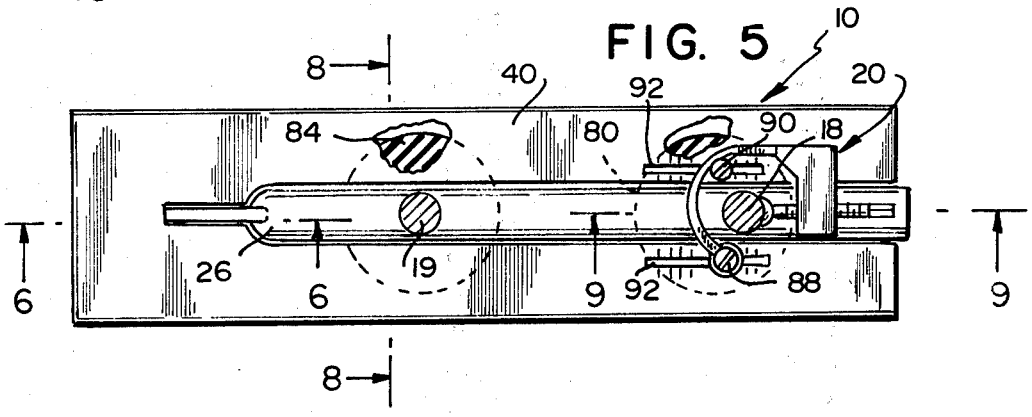
FIG. 5 is a top plan view of the ice skate attachment of the instant invention taken along the line 5—5 of FIG. 1, with the alternate resilient device disclosed in dotted lines.

FIG. 5 shows a top plan view of the attachment device utilizing an alternative embodiment for the resilient members 84 and 86 which may be manufactured from a resilient device such as rubber or any other material sufficient to withstand the temperature range under which it is to be utilized and with sufficient resiliency to support the necessary weight. The resilient members 84 and 86 are C-shaped and are designed to encompass the shoe support posts 18 and 19 and clear the clamping bracket assembly 20 as shown in FIG. 9.

Figure 6:
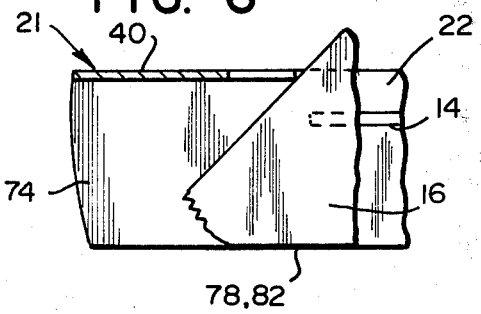
FIG. 6 is a view taken along line 6—6 in FIG. 5.

FIG. 6 discloses the front portion of an ice skate blade 16, after having cleared the slot 24 provided in receptacle 22. The blade 16 is pushed forward until it abuts the flat portion 40 of the frame 21 and is held in that position by the combination of the clamping assembly 20 and the selection of the proper adjustment slot position into which the swivel pins 88 and 90 are positioned. The adjustment slots 92 are chosen according to the distance between the shoe support post 18 and 19.

Figure 8:
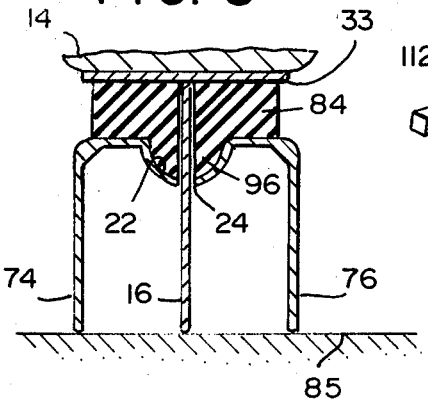
FIG. 8 is a cross-section in elevation taken along the line 8—8 of FIG. 5.

FIG. 8 is a cross-sectional view in elevation along the line 8—8 of FIG. 5. The alternative resilient material 84 is utilized as shown in FIG. 8, when the blade portion 16 of the ice skate 12 is not provided with an enlarged portion. The resilient member 84 is provided with the protruding portion 96 that is received by receptacle 22 in the same manner as the enlarged portion 26 is received therein. The resilient member 84 will compress when the weight of the person utilizing the attachment device is placed upon the inwardly position blade in the execution of a sharp turn or curve.

Figure 7:
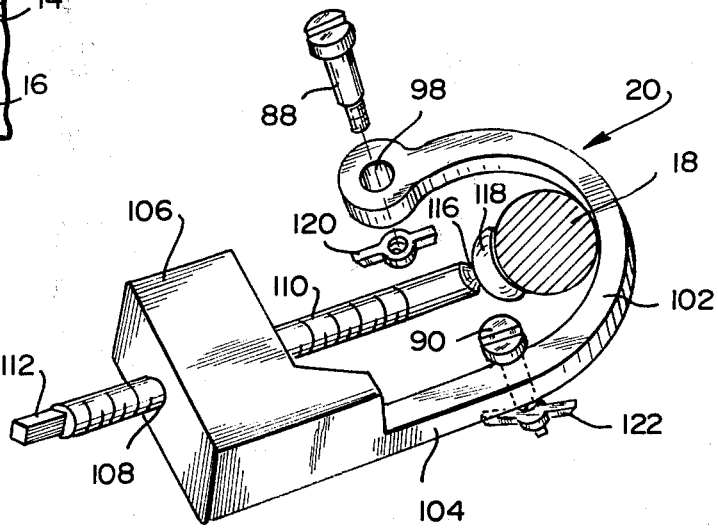
FIG. 7 is an enlarged isometric pictorial representation of the clamping device utilized to hold the skate attachment device to the support post of an ice skate.

FIG. 7 discloses an enlarged perspective view of the clamping bracket assembly utilized to clamp the frame 21 to the rear shoe support post 18. The swivel pin 88 is inserted into aperture 98 provided in the U-shaped bracket portion 102. One of the arms 104 of the bracket portion 102 terminates in an enlarged block portion 106 which is provided with a horizontally disposed threaded aperture 108 which is adapted to receive a threaded rod 110 therein.

The threaded rod 110 is provided at one distal end with a rectangularly shape portion 112 adapted to receive into a mating key for rotation therewith. The other distal end 116 is provided with a cup swivel 118 adapted to cooperate with and hold the shoe support post 18 to prevent longitudal movement of the attachment device while permitting transverse rotational movement as required.

In operation the ice skate is inserted into the slot 24 of the attachment device provided in the frame 21. The proper position in the slots 92 is selected depending on the location of the vertical support post 18 and is fastened and locked into place by retaining locking wing nuts 120 and 122. With the use of a key or wrench, not shown, the rectangularly shaped portion 112 or rod 110 is rotated until the cup swivel exerts sufficient pressure on the shoe support post to maintain the attachment device 10 firmly in position. The rubber resilient members 84 and 86 may then be inserted or if the spring members 30, 32, 34 and 36 are to be utilized, they would already have been assembled on to the horizontal flat portion 40. Once assembled to the skate the user may don these skates and be prepared for many hours of enjoyment without suffering from ankle strain or expending undue amounts of energy.

Hereinbefore has been disclosed a simple energy saving ice skate attachment device which may be utilized by individuals learning to ice skate and by those who have achieved that skill and wish to conserve energy. It will be understood that various changes in the details, materials, arrangement of parts and operating conditions which have been herein described and illustrated in order to explain the nature of the invention, may be made by those skilled in the art within the principals and scope of the present invention.

Having thus set forth the nature of the invention what is claimed is:

1. An energy saving ice skate device for attachment to ice skates, or the like, also suitable for training skaters comprising:

(a) an elongated frame having, (i) a centrally disposed longitudinal receptacle provided with an elongated centrally disposed slot adapted to receive the blade of an ice skate therethrough, (ii) two longitudinal outboard ice skate blades, one positioned on each side of said receptacle by a horizontal portion of said frame, the edges of said outboard blades being coplanar with the edge of said ice skate blade, (iii) clamp means for releasably affixing said frame to one shoe support post of said ice skate for prohibiting longitudinal movement between said ice skate blade and said outboard blades; and (b) resilient means disposed between said horizontal frame portion and the bottom surface of the shoe portion of said ice skate.

2. An ice skate attachment device according to claim 1 wherein said resilient means comprising at least one spring means.

3. An ice skate attachment device according to claim 2 wherein said spring means is affixed to the horizontal portion of said frame and extends upwardly therefrom.

4. An ice skate attachment device according to claim 3 wherein said spring means is removably affixed to the horizontal portion of said frame by mounting means provided in the horizontal portion of said frame, said mounting means including:

(i) aperture means, (ii) rod means having external threads, (iii) retaining means affixed proximate the unthreaded end of said rod means, and (iiii) a coil spring disposed between said retaining means and the horizontal portion of said frame, said rod means threaded portion being disposed within said coil spring and received by said aperture, said locking means being disposed on the underside of said horizontal portion of said frame means.

5. An ice skate attachment device according to claim 1 wherein the enlarged portion of said ice skate blade is adapted to be received and cooperate with said longitudinal frame receptacle.

6. An ice skate attachment device according to claim 5 further including resilient friction reducing means disposed between said enlarged blade portion and said longitudinal frame receptacle.

7. An ice skate attachment device according to claim 6 wherein said resilient friction reducing means is a sheet of fluorocarbon known as Teflon.

8. An ice skate attachment device according to claim 1 wherein said resilient means is rubber C-shaped member disposed to encompass each said shoe support post with the underside of said member being received by said longitudinal receptacle.

9. An ice skate attachment device according to claim 1 wherein said clamp means comprises:

(a) a U-shapes bracket means having, (i) one arm longer than the other with a vertical aperture provided at the distal end of said short arm and a vertical aperture provided on said longer arm, (ii) a block portion having a horizontally threaded aperture provided therein, disposed on the end of said longer arm;

(b) externally threaded rod means having, (i) a squared distal end, and (ii) a swivel distal end, said rod means being adapted to be received by said block threaded horizontal aperture and cooperate therewith, said swivel end extending towards said U-shaped bracket means; and (c) a pair of pivot means, one of said pivot means adapted to be received by each of said bracket means vertical apertures and received by apertures provided in said horizontal frame portion, said rod means swivel end cooperating with said U-shaped bracket means to clamp said shoe support post therebetween.

* * * * *